US006594908B2

(12) United States Patent
Di Amico

(10) Patent No.: US 6,594,908 B2
(45) Date of Patent: Jul. 22, 2003

(54) MOTORIZED ROTATING FORK

(76) Inventor: Paul Di Amico, 601 N. Kirby St., Hemet, CA (US) 92545

( * ) Notice: Subject to any disclaimer, the term of this patent is extended or adjusted under 35 U.S.C. 154(b) by 5 days.

(21) Appl. No.: 09/965,314

(22) Filed: Sep. 26, 2001

(65) Prior Publication Data

US 2003/0056375 A1 Mar. 27, 2003

(51) Int. Cl.[7] ..... A47J 43/28
(52) U.S. Cl. ..... 30/322
(58) Field of Search ..... 30/322, 323, 324, 30/142, 137, 147, 148, 150, 205, 206, 264

(56) References Cited

U.S. PATENT DOCUMENTS 3,589,009 A * 6/1971 Miscavich et al. ..... 30/322
3,851,501 A * 12/1974 Levin et al. ..... 66/163
4,600,826 A * 7/1986 Ishimura ..... 219/492
5,062,211 A 11/1991 Di Amico ..... 30/322
6,442,846 B1 * 9/2002 Michael ..... 30/322

* cited by examiner

*Primary Examiner*—Hwei-siu Payer
(74) *Attorney, Agent, or Firm*—Fulwider Patton Lee & Utecht, LLP

(57) ABSTRACT

The present invention is an eating utensil, in particular a motorized rotating fork. The preferred embodiment of the utensil contains an improved electromechanical motor switching system in the fork's handle. The system comprises a cam attached to an electric motor that is in electrical contact with a battery power source. Preferably, the cam has a lobe to contact a portion of the switch and stop the cam. The motor has an activation switch and the switch is in contact with the cam's lobe when it is in stopped position. When the switch is depressed it does not contact the cam and as a result, the cam and the tines attached to the cam will rotate. When the cam and preferably, the lobe, contact the switch the electrical circuit is closed and does not rotate. Preferably, if the cam has a lobe, it will rotate until the lobe reaches a stopped position which allows the stopped position to be constant.

23 Claims, 3 Drawing Sheets

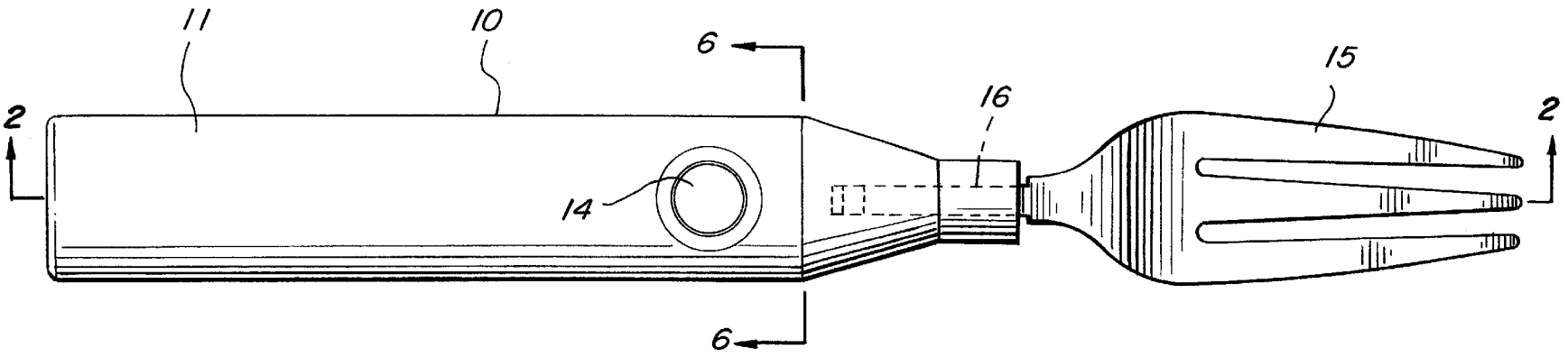
FIG. 1
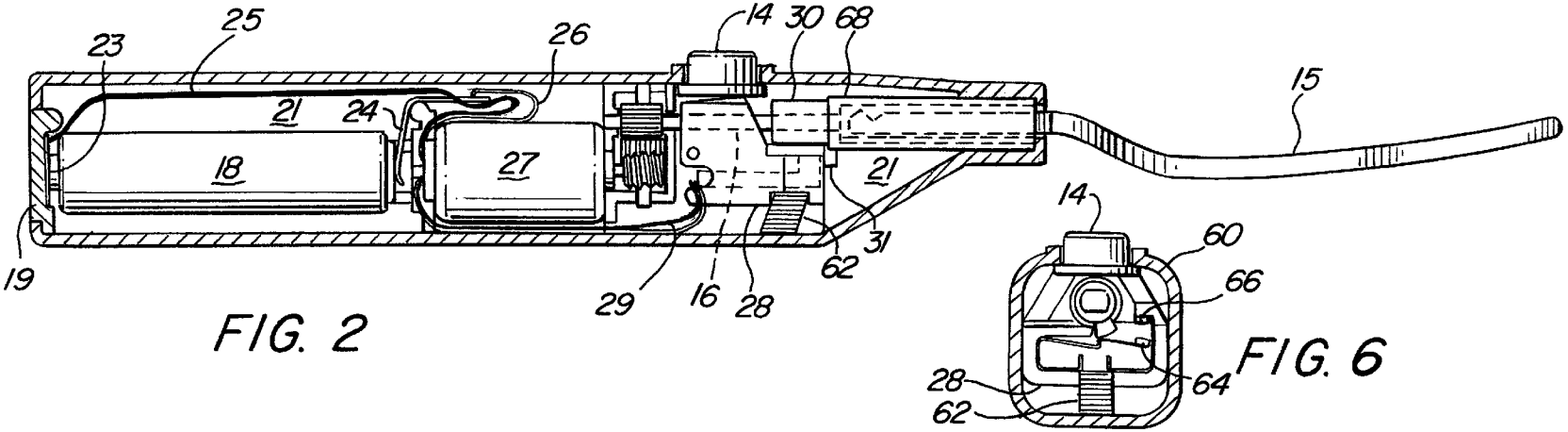
FIG. 6
FIG. 2

MOTORIZED ROTATING FORK

TECHNICAL HELD

The present invention is directed to an eating utensil, and in particular to a motorized rotating fork.

BACKGROUND ART

As most people know, eating spaghetti or noodles can be a trying experience. To gather the noodles it is necessary to rotate and twist the fork artfully just to create a cohesive bite. Even when the noodles are collected, consuming the food without making a mess is a rarity. If the food does not remain collected, dangling or loose pieces of pasta, spaghetti or noodles can dislodge and soil the user. A motorized rotating fork is useful in collecting food such as noodles and allows the user to consume the food more easily and with less chance of embarrassment.

A difficulty with a motorized fork is that the stopped position of the fork is random. When the utensil stops rotating the tines may not be in a comfortable or effective position for eating. This random position makes it uncomfortable or difficult to consume the food on the utensil. The utensil then needs to be rotated manually, defeating the original purpose of the motorized rotation. Thus, a motorized utensil that has a pre-determined stopped position would allow for easier collection and consumption of food.

SUMMARY OF THE INVENTION

The present invention is an eating utensil, and in particular a motorized rotating fork. The preferred embodiment of the utensil contains an improved electromechanical motor switching system in the fork's handle which allows for increased reliability and simplicity while reducing the cost. The system comprises a cam attached to an electric motor that is in electrical contact with a power source such as a battery. Preferably, the cam has a lobe for halting the cam's rotation. The motor has an activation switch and the switch is in contact with the cam's lobe when the cam is in a stopped position. When the switch is activated it moves out of contact with the cam and, as a result, the cam and the tines attached to the cam rotate. When the cam, and preferably the lobe, contact the switch, the electrical circuit is closed and the cam stops rotating. The cam's lobe will rotate freely until the lobe reaches a predetermined position which allows the final orientation position to be predetermined.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 1 is a front view of a preferred embodiment of the invention;

FIG. 2 shows a side sectional view of the preferred embodiment;

FIG. 6 is a sectional view of the preferred embodiment of the present invention of FIG. 1.

DETAILED DESCRIPTION OF THE PREFERRED EMBODIMENTS

Figure 3B:
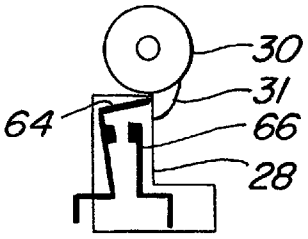
FIGS. 3A and 3B show schematic side and profile views of the preferred embodiment of the invention when in a stopped position.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a motorized rotating fork.

Referring now to FIGS. 1 and 6, a preferred embodiment of the invention is shown. The preferred embodiment is as a fork 10 which has a handle 11 housing the electromechanical switching components. The handle 11 may have thumb or finger grooves (not shown) on its external surface for easier handling. The handle 11 has a button 14 and is attached to tines 15 by a shaft 16 that connects to the handle 11 in the handle's internal compartment 20.

FIG. 2 shows a side sectional view of the fork's handle 11. One end of the handle's internal compartment 21 includes a storage compartment 20 for housing a battery 18. The battery storage compartment 20 is covered by a pivoted battery door 19 to provide easy access to the battery 18. The battery storage compartment 20 has a positive and a negative contact 23, 24 respectively, for contacting the battery terminals. The positive contact 23 is connected to a wire 25 that connects to the motor 27. The negative contact 24 is connected to a wire 26 that connects to the activation switch 28. A wire 29 also connects the motor 27 to the switch 28. The switch 28 is mechanically connected to the button 14 that is located externally on the handle 11.

The internal compartment 21 also houses a cam 30 that is rotably attached to the shaft 16. The motor 27 turns the cam 30 through a gear train 70, the shaft 16, and the tines 15 of the fork 10.

Figure 3A:
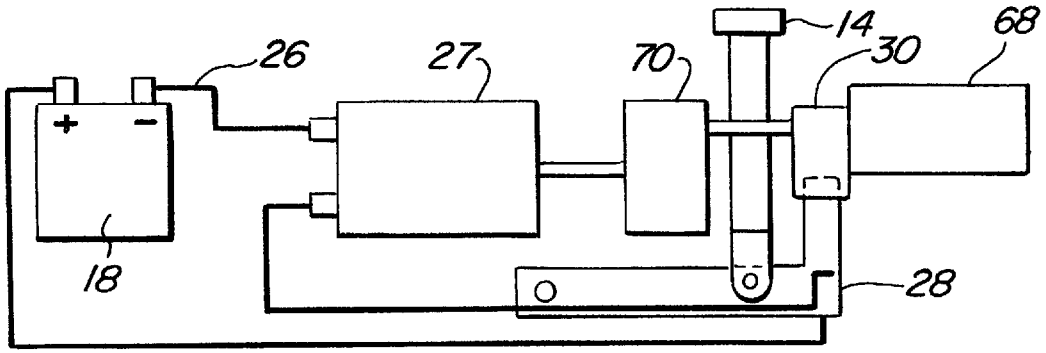
Figure 4B:
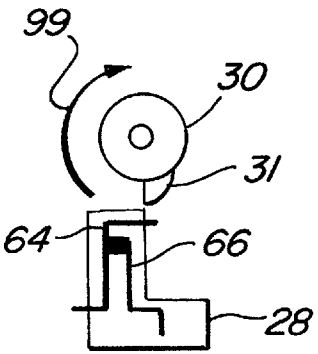
FIGS. 4A and 4B show schematic side and profile views of the preferred embodiment of the invention during rotation.
Figure 4A:
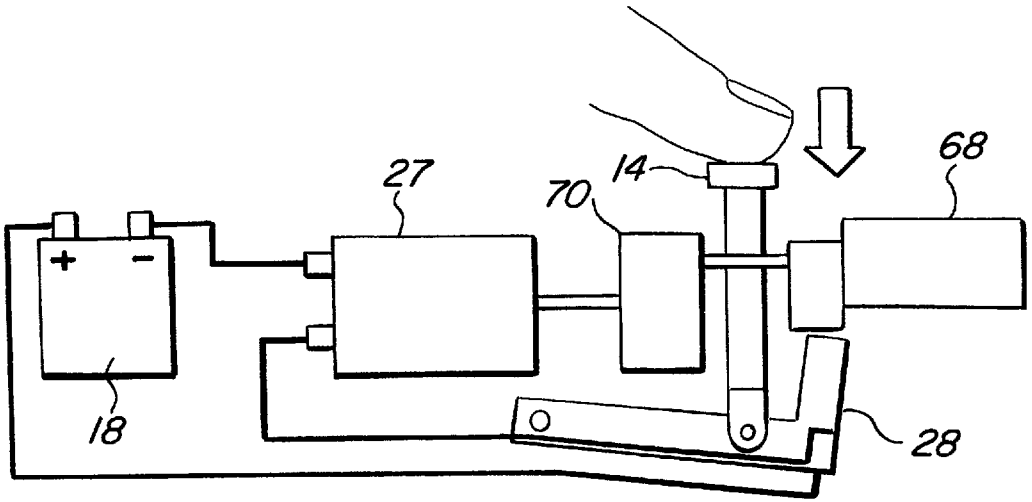

FIGS. 3–5 show a sequence of positions occupied by the components when the fork 10 is activated. The button 14, switch 28, and cam 30 are collectively called a switching system. The button 14 is connected to the activation switch 28 in the handle's internal compartment 20. The button 14 and the switch 28 have a released position (FIGS. 3A,B) and a depressed position (FIGS. 4A,B). When the button 14 and the connected switch 28 are in the released position, the cam 30 as shown in FIG. 3B is in a stopped position and the shaft 16 and tines 15 do not rotate. Conversely, when the button 14 and the connected switch 28 are in the depressed position as shown in FIG. 4B, the motor 27 rotates the cam 30 which rotates the shaft 16 and the tines 15.

FIGS. 3A and 3B show that in a preferred embodiment, when the button 14 is in the released position, the switch 28 is in contact with the cam 30 at the lobe 31, thereby impeding the cam 30 from rotating. The position of the cam 30 moves the first contact 64 out of electrical contact with the second fixed contact 66, creating an open circuit. This open electrical circuit prevents the motor from engaging, and the tines 15 of the fork 10 will not rotate.

FIGS. 4A and 4B show that when the button 14 and the switch 28 are in the depressed position, the switch 28 is retracted from the path of the cam 30 and lobe 31 as given by arrow 99. The contact 64, which is biased by spring 62, contacts the fixed contact 66. This condition creates a closed electrical circuit, engaging motor 27 which in turn rotates the cam 30 freely.

Figure 5B:
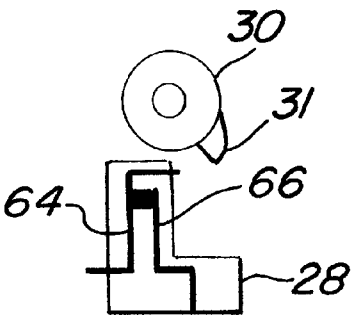
FIGS. 5A and 5B show schematic side and profile views of the preferred embodiment of the invention when stopped at a predetermined position.
Figure 5A:
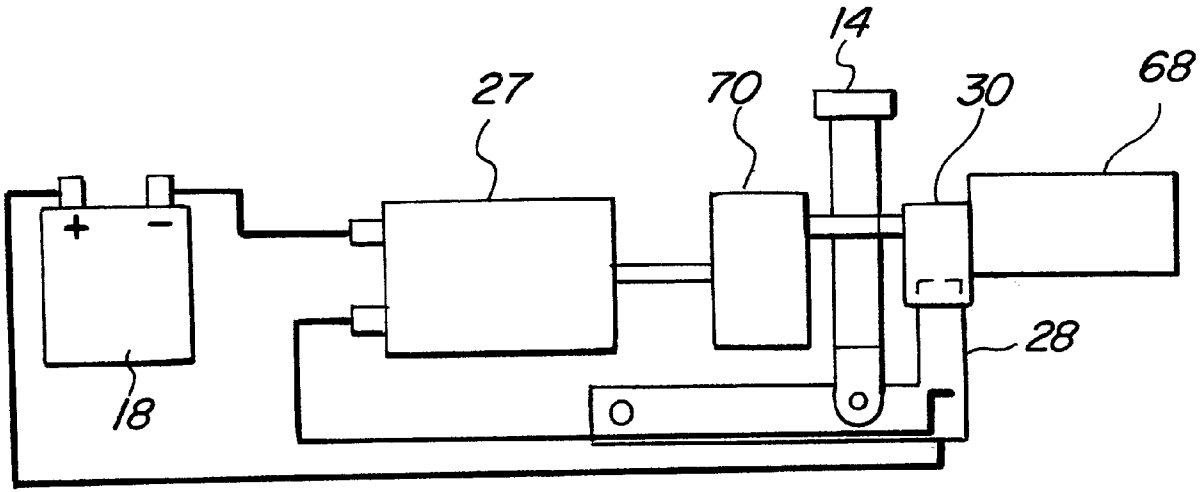

FIGS. 5A and 5B shows that when the button 14 is released by the user and the switch 28 moves to the released position, the cam 30 rotates until the lobe 31 contacts the switch 28. When the switch 28 contacts the lobe 31, the force of the rotating cam separates the contact 64 from the fixed contact 66, and the electrical circuit re-opens as shown in FIG. 3. With the power to the cam 30 and tines 15 disconnected, they will rotate until halted by the lobe 31 contacting the switch 28. The lobe 31 halts the cam 30 and tines 15 at the pre-determined stopped position. This returns the tines 15 to the same pre-rotation position every time.

The improved single switch technology is believed to be novel. A single switch mechanism increases reliability and simplicity while reducing the cost of the fork 10. Furthermore, the single switch system allows for better control of the fork 10 in terms of the consistent stopping position of the tines 15.

FIGS. 1 and 2 show that the handle's internal compartment 21 is covered to prevent the battery 18, the motor 27, and the switching system from being be exposed to dirt, food or other foreign matter that may interfere with the operation of the fork 10. The rotating tines 15 and the shaft 16 protrude from the compartment 21 and lie on the central longitudinal axis of the handle 11. The rotation of the cam 30, the shaft 16 and the tines 15 all occur about the central longitudinal axis. Such construction provides a preferred embodiment for collecting food onto the tines 15.

Thus, it can be seen that the motorized fork of the present invention provides a handle 11 which is held by the hand of the user. The user depresses the button 14, activating the switch 28 and energizing the motor 27. The motor is energized by the battery 18 or other power source. The tines 15 rotate at a constant speed and the user may elect to start and stop the rotation at the user's convenience by depressing or releasing the button 14, respectively. Furthermore, when the button 14 is released the tines 15 return to the pre-determined stopped position. This reduces the difficulty and discomfort of consuming food collected on the fork.

In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate the adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An eating utensil comprising:

a plurality of tines extending from a shaft;

the shaft rotatably attached to a cam inside an internal compartment of a handle;

said compartment further containing an electric motor attached to the cam and in electrical contact with a power source;

said motor having an activation switch connected to a button externally positioned on the handle.

2. The utensil of claim 1, wherein said power source is a battery.

3. The utensil of claim 1, wherein said plurality of tines comprises a fork element.

4. The utensil of claim 1, wherein said electric motor tunes said cam and said shaft in a rotary movement about a longitudinal axis of said handle.

5. The utensil of claim 1, wherein said button when depressed moves said switch away from said cam allowing the cam to rotate.

6. The utensil of claim 1, wherein said button when released allows the switch to stop said cam.

7. The utensil of claim 1, where said cam has a lobe that contacts said switch in a stopped position.

8. The utensil of claim 7, wherein contact between said switch and said lobe creates an open electrical circuit.

9. The utensil of claim 7, where said switch when depressed closes the electrical circuit allowing said cam to rotate freely.

10. The utensil of claim 7, where said switch when released contacts the rotating cam and the lobe at the stopped position.

11. An improved electric motor switching system contained in a motorized fork's handle, said improvement comprising:

a cam attached to an electric motor in electrical contact with a batter power source;

said motor having an activation switch with a depressed position and a released position; and said switch being in contact with said cam.

12. The system of claim 11, where said switch in contact with said cam impedes the cam from rotating.

13. The system of claim 11, where said switch in the depressed position does not contact said cam.

14. The system of claim 11, where said switch when in the depressed position contacts a wire connected to said motor.

15. The system in claim 11, wherein said cam rotates unless in contact with said switch.

16. The system of claim 11, where said cam has a lobe, said lobe when in a stopped position contacts said switch.

17. The system of claim 16, where said lobe when in contact with said switch maintains an open electrical circuit.

18. The system of claim 16, where said switch when depressed does not contact said lobe.

19. The system of claim 16, where said switch when in the depressed position closes the electrical circuit and allows said cam to rotate freely.

20. The system of claim 16, where said switch when released contacts the came and the lobe at the stopped position.

21. An improved rotating fork comprising:

a handle housing a power supply, a motor, an electrical circuit connecting the motor with the power supply, and a switch for decoupling the power supply from the motor;

a fork element including a plurality of time, the fork element rotated by the motor about a longitudinial axis; and a lobe for bringing the rotating fork element to rest at a pre-determined position.

22. The improved fork of claim 21, where the lobe is disposed on a cam driven by the motor.

23. The improved fork of claim 21, where the lobe engages the switch for decoupling the power supply from the motor.

* * * * *